US012435505B2

(12) United States Patent
Ebisu

(10) Patent No.: US 12,435,505 B2
(45) Date of Patent: Oct. 7, 2025

(54) JOINT STRUCTURE AND BUILDING

(71) Applicant: SAI GROUP HOLDINGS KABUSHIKI KAISHA, Fukuoka (JP)

(72) Inventor: Kenya Ebisu, Fukuoka (JP)

(73) Assignee: SAI GROUP HOLDINGS KABUSHIKI KAISHA, Fukuoka (JP)

( * ) Notice: Subject to any disclaimer, the term of this patent is extended or adjusted under 35 U.S.C. 154(b) by 154 days.

(21) Appl. No.: 18/012,953

(22) PCT Filed: Jun. 24, 2021

(86) PCT No.: PCT/JP2021/023901
§ 371 (c)(1),
(2) Date: Dec. 26, 2022

(87) PCT Pub. No.: WO2021/261542
PCT Pub. Date: Dec. 30, 2021

(65) Prior Publication Data

US 2023/0257991 A1 Aug. 17, 2023

(30) Foreign Application Priority Data

Jun. 25, 2020 (JP) ..... 2020-109816

(51) Int. Cl.
*E04B 1/48* (2006.01)

(52) U.S. Cl.
CPC ..... *E04B 1/486* (2013.01)

(58) Field of Classification Search
CPC ..... E04B 1/486; E04B 2001/6191; E04B 2001/6195; E04B 1/6116
See application file for complete search history.

(56) References Cited

U.S. PATENT DOCUMENTS 733,500 A * 7/1903 Moore ..... E04B 1/2604 403/381
11,629,489 B2 * 4/2023 Ebisu ..... E04B 1/612 52/592.1

(Continued)

FOREIGN PATENT DOCUMENTS

JP S6154903 A 3/1986
JP 2009243183 A 10/2009
JP 202020257 A 2/2020

OTHER PUBLICATIONS

International Search Report for related International Application No. PCT/JP2021/023901 mailed Aug. 24, 2021 and its English Translation.

(Continued)

*Primary Examiner* — Patrick J Maestri
(74) *Attorney, Agent, or Firm* — Renner, Otto, Boisselle & Sklar, LLP

(57) ABSTRACT

The present invention addresses the problem of providing a joint structure which comprises a joint member suitable for a butterfly joint, and a building. The joint structure according to the present invention includes a first wood panel, a second wood panel, and a butterfly wedge-shaped joint member for joining the first wood panel and the second wood panel. The joint structure has an allowable yield strength of about 10 kN or more. In one embodiment, the ratio of the bending strength of the wood panels to the bending strength of the joint member in the joint structure is 1:2.2 to 1:3.6. In addition, the joint structure according to the present invention may further include a joint member comprising laminated wood in which a plurality of plate materials are laminated.

14 Claims, 6 Drawing Sheets

(56) References Cited

U.S. PATENT DOCUMENTS

| | | | | |
|---|---|---|---|---|
| 2001/0032434 | A1* | 10/2001 | Hoffmann | E04B 1/2604 52/703 |
| 2004/0139680 | A1* | 7/2004 | Hambright | E04B 2/06 52/582.1 |
| 2011/0265310 | A1* | 11/2011 | Beaulieu | A47B 97/00 29/525.08 |
| 2017/0350432 | A1* | 12/2017 | Hudson | E04C 2/205 |

OTHER PUBLICATIONS

First Office Action for corresponding Japanese Application No. 2020-109816 dated Sep. 28, 2020 and its English Machine Translation.

Second Office Action for corresponding Japanese Application No. 2020-109816 dated Dec. 2, 2020 and its English Machine Translation.

* cited by examiner (a)

(b)

(a)

(b)

JOINT STRUCTURE AND BUILDING

This application is a national phase of International Application No. PCT/JP2021/023901 filed 24 Jun. 2021, which claims priority to Japan Application No. 2020-109816 filed 25 Jun. 2020, the entireties of which are hereby incorporated by reference.

TECHNICAL FIELD

The present invention relates to a joint structure and a building comprising the joint structure.

BACKGROUND ART

Butterfly joint has been known as a method of joining lumber (e.g., wooden furniture).

CITATION LIST

Non Patent Literature

[NPL 1] Sapporo Furnishing Co. Ltd., "Method of joining lumber", [online], [retrieved on Mar. 25, 2020], Internet <URL: http://www.sf-terra.co.jp/interior/mame/other/56/>

SUMMARY OF INVENTION

Technical Problem

The objective of the present invention is to provide a joint member suited for a novel butterfly joint, which is suitable as a component of a building, and a joint structure comprising the same.

Solution to Problem

The present invention provides, for example, the following.

(Item 1)

A joint structure comprising a first wooden panel, a second wooden panel, and a butterfly joint member for joining the first wooden panel and the second wooden panel, wherein the joint structure has an allowable bearing capacity of about 10 kN or greater.

(Item 2)

The joint structure of item 1, wherein the joint member comprises engineered wood prepared from laminating plurality of board members.

(Item 3)

The joint structure of item 2, wherein the plurality of board members comprise a first board member having a first fiber orientation and a second board member having a second fiber orientation which is different from the first fiber orientation, a total volume of the first board member is greater than a total volume of the second board member, and a height direction of the joint member is substantially identical to the first fiber orientation.

(Item 4)

The joint structure of item 2, wherein the plurality of board members comprise only a plurality of first board members having a first fiber orientation, and a height direction of the joint member is substantially identical to the first fiber orientation.

(Item 5)

The joint structure of item 4, wherein the joint member has a structure prepared from laminating the plurality of first board member such that a strength of the plurality of first board members is symmetric with respect to a central axis in the height direction of the joint member.

(Item 6)

The joint structure of any one of items 1 to 5, wherein the joint member has a rounded corner section.

(Item 7)

The joint structure of item 6, wherein a radius of the rounded corner section is 6 to 15 mm.

(Item 8)

The joint structure of any one of items 1 to 7, wherein a dovetail groove is formed at each of a predetermined position on a joint section of the first wooden panel and a predetermined position on a joint section of the second wooden panel, a cross-sectionally dovetail shaped space corresponding to a shape of the joint member is formed by matching a position of a dovetail groove of the first wooden panel and a position of a dovetail groove of the second wooden panel, and the first wooden panel and the second wooden panel are configured to be joined with each other by inserting the joint member into the cross-sectionally dovetail shaped space.

(Item 9)

The joint structure of any one of items 1 to 8, wherein the joint structure does not comprise a metal part for joining the first wooden panel and the second wooden panel.

(Item 10)

The joint structure of any one of items 1 to 9, wherein the first wooden and the second wooden panel are fabricated with a cross laminated timber.

(Item 11)

The joint structure of any one of items 1 to 10, wherein lengths of the first wooden panel and the second wooden panel in a width direction are each about 300 mm to about 800 mm.

(Item 12)

The joint structure of any one of items 1 to 11, wherein a size of the joint member has a length in a height direction of about 150 mm to about 270 mm, a length in a width direction of about 150 mm to about 270 mm, a thickness of about 90 mm to about 270 mm, and a shortest length between side surfaces of about 75 mm to about 135 mm.

(Item 13)

The joint structure of any one of items 1 to 12, wherein flexural strength of the wooden panels:flexural strength of the joint member is 1:2.2 to 1:3.6.

(Item 14)

The joint structure of any one of items 1 to 13, wherein the joint structure has an ultimate bearing capacity of about 18 kN or greater.

(Item 15)

A building comprising the joint structure of any one of items 1 to 14.

(Item 16)

A joint member used in the joint structure of any one of items 1 to 14.

Advantageous Effects of Invention

The present invention can provide a building and a joint structure comprising a joint member, which is suited for a butterfly joint.

DESCRIPTION OF EMBODIMENTS

Definitions

The terms used herein are defined hereinafter.

As used herein, "about" refers to a range of +10% from the numerical value that is described subsequent to "about".

As used herein, yield point load refers to the load applied as of the start of yield.

As used herein, allowable bearing capacity refers to the size of the smaller of ⅔ of the maximum load and yield point load.

As used herein, ultimate bearing capacity refers to the size of load applied as of the start of at least a partial collapse.

The embodiments of the invention are described hereinafter with reference to the drawings. Throughout the entire specification, the same reference numbers are used for the same constituent elements.

(Joint Structure)

Figure 1:
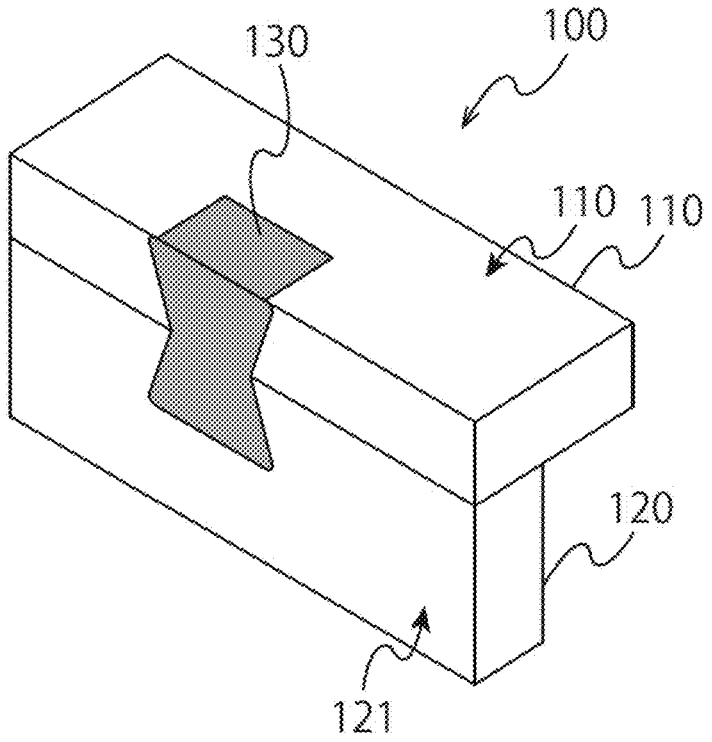
FIG. 1 is a diagram showing an example of the joint structure of the invention.
Figure 1:
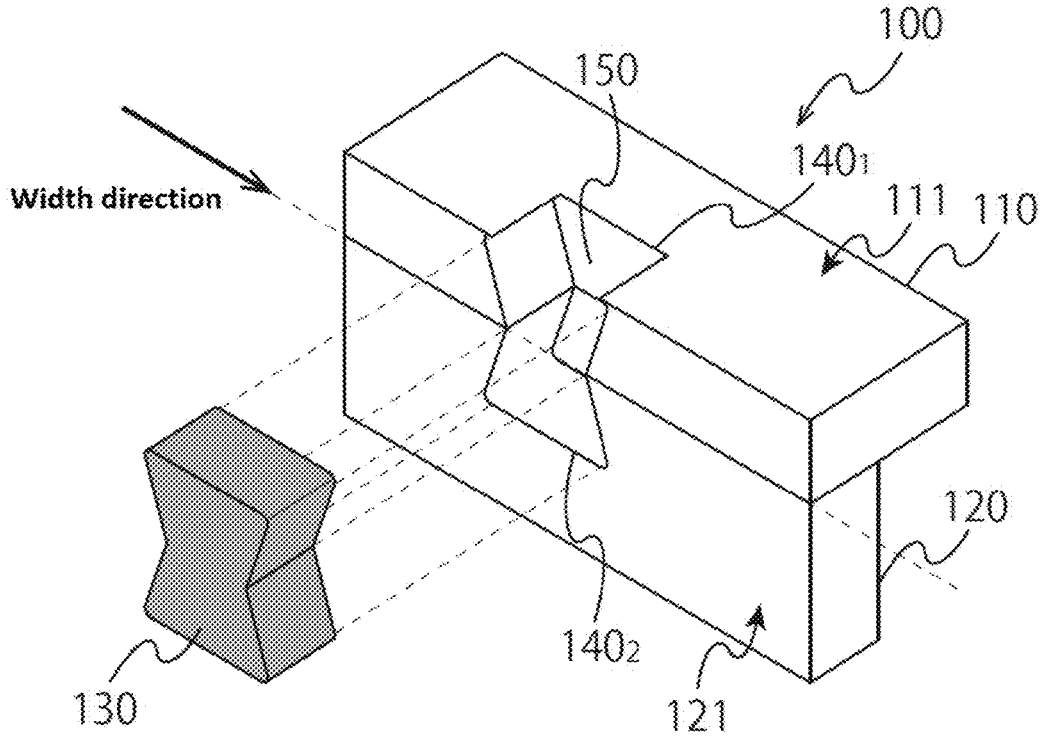

FIG. 1 shows an example of the joint structure of the invention. FIG. 1*a* shows an example of the structure of a joint structure 100 in a joined state, and FIG. 1*b* is an exploded view of the joint structure 100 shown in FIG. 1*a*.

In the embodiments shown in FIGS. 1*a* and 1*b*, the joint structure 100 comprises a wooden panel 110, a wooden panel 120, and a butterfly joint member 130 for joining the wooden panel 110 and the wooden panel 120. In this regard, a surface with a relatively larger surface area of the wooden panel 110 is the main surface 111 of the wooden panel 110, and a surface with a relatively larger surface area of the wooden panel 120 is the main surface 121 of the wooden panel 120 in the present invention. In the embodiments shown in FIGS. 1*a* and 1*b*, the wooden panel 110 and the wooden panel 120 are arranged to be substantially orthogonal to each other (i.e., the main surface 111 of the wooden panel 110 and the main surface 121 of the wooden panel 120 are substantially orthogonal).

As shown in FIG. 1*b*, a dovetail groove $\mathbf{140}_1$ (i.e., first opening with a substantially isosceles trapezoidal shape) corresponding to the shape of one half of the joint member 130 in order to fit in the one half of the joint member 130 is formed at a predetermined position on a joint section of the wooden panel 110. A dovetail groove $\mathbf{140}_2$ (i.e., second opening with a substantially isosceles trapezoidal shape, which is line symmetric with the first opening with respect to an axis along the top base of the first opening) corresponding to the shape of the other half of the joint member 130 in order to fit in the other half of the joint member 130 is formed at a predetermined position on a joint section of the wooden panel 120. In the embodiments shown in FIGS. 1*a* and 1*b*, the shape of the opening of the dovetail groove $\mathbf{140}_1$ appearing on the main surface 111 of the wooden panel 110 is rectangular, and the shape of the dovetail groove $\mathbf{140}_2$ appearing on the main surface 121 of the wooden panel 120 is a substantially isosceles trapezoidal shape. The difference between the wooden panel 110 and the wooden panel 120 is due to arranging the wooden panel 110 and the wooden panel 120 to be orthogonal as shown in FIG. 1*b*. The shapes of the dovetail grooves $\mathbf{140}_1$ and $\mathbf{140}_2$ are not limited to a substantially isosceles trapezoidal shape, and may be a substantially convex shape (e.g., a shape combining a quadrangular shape on the bottom of a substantially isosceles trapezoidal shape). In a preferred embodiment, the shape of a dovetail groove is a substantially isosceles trapezoidal shape.

A space 150 with a cross-sectionally dovetail shape corresponding to the overall shape of the joint member 130 (i.e., butterfly joint concave shape made by combining the dovetail groove $\mathbf{140}_1$ and the dovetail groove $\mathbf{140}_2$) is formed by matching the positions of the dovetail groove $\mathbf{140}_1$ of the wooden panel 110 and the dovetail groove $\mathbf{140}_2$ of the wooden panel 120. The wooden panel 110 and the wooden panel 120 are fixed with the joint member 130 and joined to each other by inserting the joint member 130 into the space 150 with a cross-sectionally dovetail shape while matching the positions of the dovetail groove $\mathbf{140}_1$ of the wooden panel 110 and the dovetail groove $\mathbf{140}_2$ of the wooden panel 120.

Hereinafter, the preferred numerical values of allowable bearing capacity or ultimate bearing capacity of a joint structure are described herein, but it should be noted that the numerical values are directed to a joint structure prepared from connecting two sheets of wooden panels with one joint member.

The joint structure 100 of the invention has an allowable bearing capacity of at least about 10 kN, preferably about 12 kN or greater, and more preferably about 14 kN or greater. In one embodiment, the joint structure 100 of the invention has an allowable bearing capacity of about 10 kN to about 25 kN, about 10 kN to about 25 kN, about 12 kN to about 25 kN, or about 14 kN to about 25 kN. A sufficient strength can be achieved in a building such as a residential building that is built by using such a joint structure through the joint structure 100 having an allowable bearing capacity of about 10 kN or greater or preferably about 12 kN or greater. In particular, it was unexpected that such allowable bearing capacities can be achieved without using a joining metal part on the joint structure 100.

The joint structure 100 of the invention has an ultimate bearing capacity of at least about 18 KN, preferably about 20 kN or greater, more preferably about 22 kN or greater, and most preferably about 25 kN or greater. In one embodiment, the joint structure 100 of the invention has an ultimate bearing capability of about 18 kN to about 35 kN, about 20 kN to about 35 kN, about 22 kN to about 35 kN, or about 25 kN to about 35 kN. A sufficient strength can be achieved in a building such as a residential building that is built by using such a joint structure through the joint structure 100 having an ultimate bearing capacity of about 18 kN or greater. The risk of collapse due to an earthquake is low through the joint structure 100 having an ultimate bearing capacity of about 18 kN or greater, and preferably about 20 kN or greater. In particular, it was unexpected that such ultimate bearing capacities can be achieved without using a joining metal part on the joint structure 100.

More specifically, in the embodiments shown in FIGS. 1*a* and 1*b*, the joint structure 100 is configured so that the wooden panel 110 and the wooden panel 120 are orthogonally connected with each other using the joint member 130. The joint structure 100 has an allowable bearing capacity of preferably about 12 kN or greater, more preferably about 13 kN or greater, and most preferably about 14 kN or greater against a shearing force in the width direction.

In the embodiments shown in FIGS. 1*a* and 1*b*, the joint structure 100 has an ultimate bearing capacity of preferably about 16 kN or greater, more preferably about 18 kN or greater, and most preferably about 20 kN or greater against a shearing force in the width direction.

In the embodiments shown in FIGS. 1*a* and 1*b*, the lengths of each of the wooden panel 110 and the wooden panel 120 in the width direction (i.e., length of a side along the direction of shortest distance between opposing apexes on the tapered inner side surfaces of dovetail grooves) is preferably about 300 mm to about 800 mm, more preferably about 400 mm to about 700 mm, and most preferably about 500 mm to about 600 mm.

Figure 2:
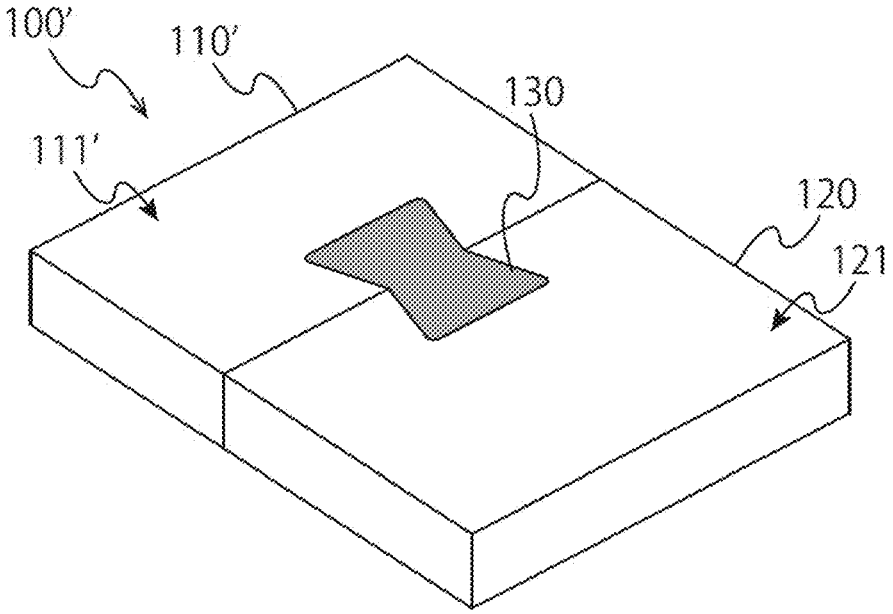
FIG. 2 is a diagram showing another example of the joint structure of the invention.
Figure 2:
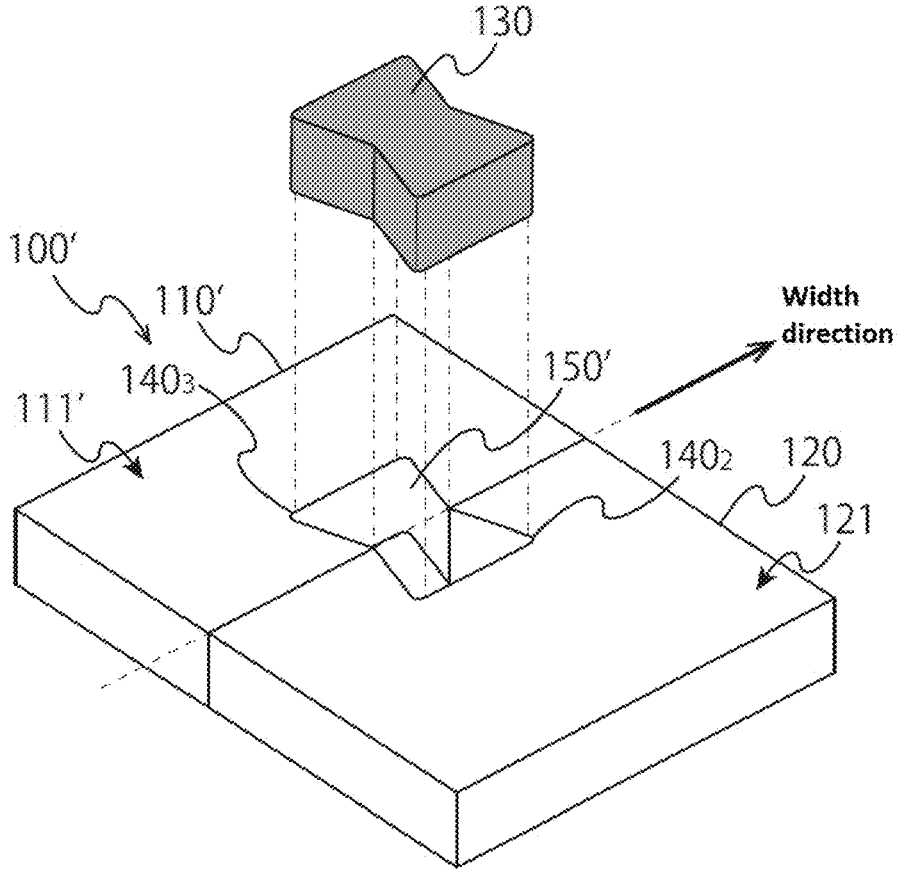

FIG. 2 shows another example of the joint structure of the invention. FIG. 2*a* shows an example of the structure of a joint structure 100' in a joined state, and FIG. 2*b* is an exploded view of the joint structure 100' shown in FIG. 2*a*.

In the embodiments shown in FIGS. 2*a* and 2*b*, the joint structure 100' comprises a wooden panel 110', the wooden panel 120, and the butterfly joint member 130 for joining the wooden panel 110' and the wooden panel 120. In this regard, a surface with a relatively larger surface area of the wooden panel 110' is the main surface 111' of the wooden panel 110', and a surface with a relatively larger surface area of the wooden panel 120 is the main surface 121 of the wooden panel 120 in the present invention. In the embodiments shown in FIGS. 2*a* and 2*b*, the wooden panel 110' and the wooden panel 120 are disposed adjacently to be substantially parallel to each other in a substantially coplanar manner (i.e., the main surface 111' of the wooden panel 110' and the main surface 121 of the wooden panel 120 are substantially parallel and substantially coplanar).

As shown in FIG. 2*b*, a dovetail groove $\mathbf{140}_3$ corresponding to the shape of one half of the joint member 130 in order to fit in the one half of the joint member 130 is formed at a predetermined position on a joint section of the wooden panel 110'. In the same manner as the embodiment shown in FIG. 1*b*, the dovetail groove $\mathbf{140}_2$ corresponding to the shape of the other half of the joint member 130 in order to fit in the other half of the joint member 130 is formed at a predetermined position on a joint section of the wooden panel 120. In the embodiments shown in FIGS. 2*a* and 2*b*, the shape of the dovetail groove $\mathbf{140}_3$ appearing on the main surface 111' of the wooden panel 110' is a substantially isosceles trapezoidal shape, and the shape of the dovetail groove $\mathbf{140}_2$ appearing on the main surface 121 of the wooden panel 120 is also a substantially isosceles trapezoidal shape.

A space 150' with a cross-sectionally dovetail shape corresponding to the overall shape of the joint member 130 (i.e., butterfly joint concave shape made by combining the dovetail groove $\mathbf{140}_3$ and the dovetail groove $\mathbf{140}_2$) is formed by matching the positions of the dovetail groove $\mathbf{140}_3$ of the wooden panel 110' and the dovetail groove $\mathbf{140}_2$ of the wooden panel 120. The wooden panel 110' and the wooden panel 120 are fixed with the joint member 130 and joined to each other by inserting the joint member 130 into the space 150' with a cross-sectionally dovetail shape while matching the positions of the dovetail groove $\mathbf{140}_3$ of the wooden panel 110' and the dovetail groove $\mathbf{140}_2$ of the wooden panel 120.

In the embodiments shown in FIGS. 2*a* and 2*b*, the joint structure 100' is configured so that the wooden panel 110' and the wooden panel 120 are connected in a manner that is parallel to each other using the joint member 130. The joint structure 100' has an allowable bearing capacity of preferably about 15 kN or greater, more preferably about 16 kN or greater, and most preferably about 18 kN or greater against a shearing force in the width direction.

In the embodiments shown in FIGS. 2*a* and 2*b*, the joint structure 100' has an ultimate bearing capacity of preferably about 25 kN or greater, more preferably about 27 kN or greater, and most preferably about 29 kN or greater against a shearing force in the width direction.

In the embodiments shown in FIGS. 2*a* and 2*b*, the joint structure 100' is configured so that the wooden panel 110' and the wooden panel 120 are connected in a manner that is parallel to each other by using the joint member 130. The joint structure 100' has an allowable bearing capacity of preferably about 11 kN or greater, more preferably about 12 kN or greater, and most preferably about 12.5 kN or greater against a tensile force in the height direction.

In the embodiments shown in FIGS. 2*a* and 2*b*, the joint structure 100' has an ultimate bearing capacity of preferably about 20 kN or greater, more preferably about 23 kN or greater, and most preferably about 25 kN or greater against a tensile force in the height direction.

In the embodiment shown in FIG. 1, the joint structure 100 may not comprise a metal part (e.g., carpenter cramp or tie plate) for joining the wooden panel 110 and the wooden panel 120, whereby a building with a sufficient strength can be built with only lumber, which is also environmentally friendly. In a preferred embodiment, the joint structure of the invention does not have a metal part for joining. Preferably, the joint structure 100 can comprise only lumber for joining the wooden panel 110 and the wooden panel 120. The same applies to the joint structure 100' shown in FIG. 2.

The thickness of a joint member and wooden panels in the joint structure of the invention can be each independently 80 mm to 100 mm, and preferably about 90 mm. In a typical embodiment, a joint member and wooden panels can have the same thickness.

As described in the Examples, the inventors found that a sufficient strength cannot be achieved if a joint member used in a butterfly joint is made from a solid wood material (i.e., lumber formed directly from a log). If stress is applied to a CLT panel joined by a joint member when the joint member used for a butterfly joint is a laminated veneer lumber (LVL) prepared from laminating a plurality of veneers while aligning the fiber orientations, the strength of the joint member is too strong relative to the strength of the CLT panel, so that the CLT panel would readily crack. Thus, a sufficient strength as a joint structure was difficult to achieve. As used herein, a CLT panel refers to "cross laminated timber" (CLT).

Specifically, to achieve a sufficient strength as a joint structure, it was revealed that the balance between the strength of a wooden panel and the strength of a joint member is important, and the strength intended by the present invention as a joint structure cannot be achieved even if the strength of either the panel or joint member is notably increased. In general, it is expected that increasing the strength of particularly a joint member in a joint structure prepared from connecting two wooden panels with the joint member leads to strengthening of the joint structure. Meanwhile, it was unexpected even to the inventors that this is not necessarily true.

In a preferred embodiment, strength (flexural strength) of wooden panels: strength (flexural strength) of a joint member can be 1:2.2 to 1:3.6, preferably 1:2.4 to 1:3.3, and more preferably 1:2.6 to 1:3.0.

For example in one embodiment, a wooden panel is a CLT panel (grade S60-3-3) with a strength (flexural strength along the strong axis in the in-plane direction) of 10.8 $N/mm^2$, and a joint member is a Scots pine engineered wood with a flexural strength of 30.0 $N/mm^2$.

(Joint Member)

Figure 3:
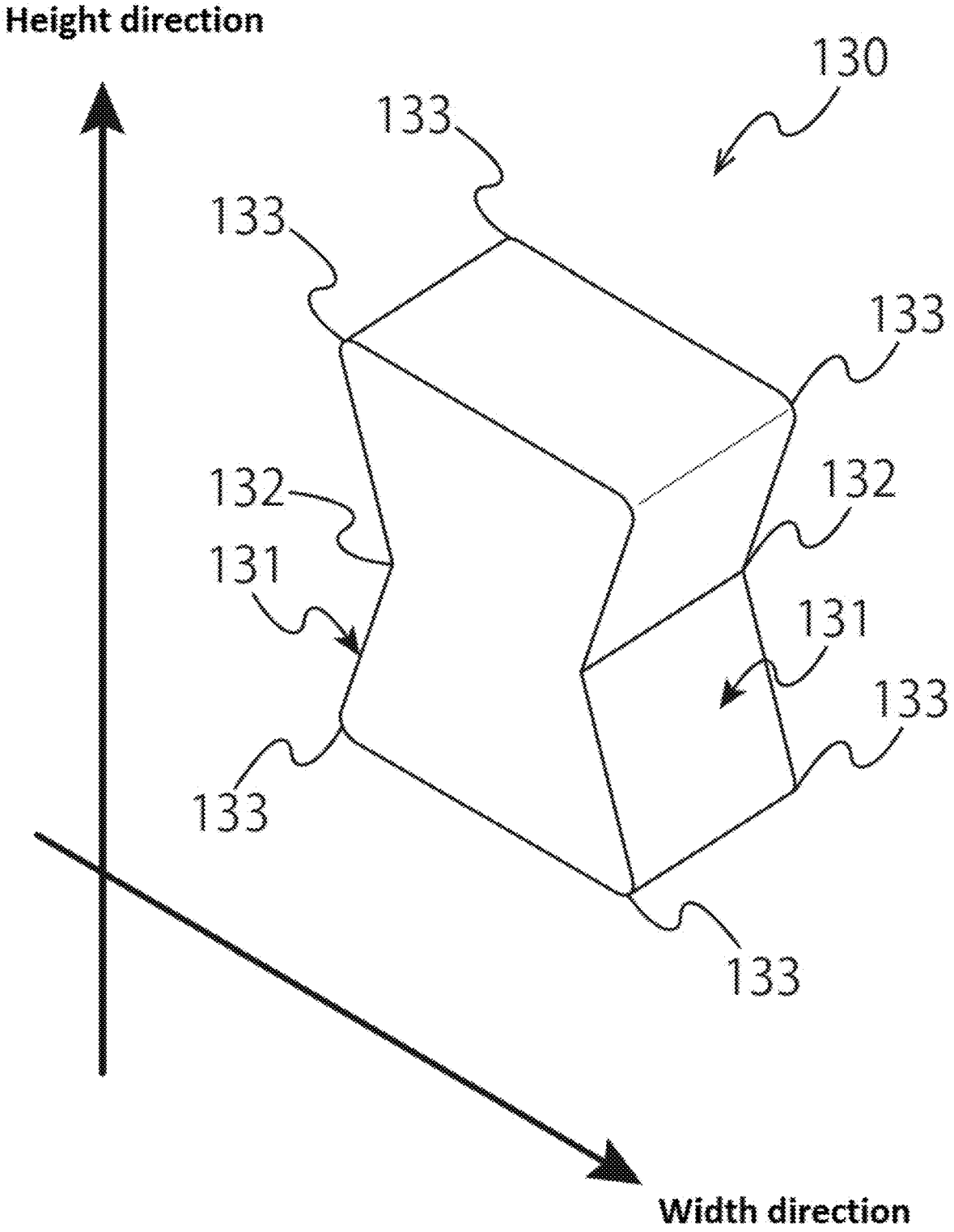
FIG. 3 is a diagram showing an example of the structure of joint member 130 shown in FIGS. 1 and 2.

FIG. 3 shows an example of the structure of the joint member 130 shown in FIGS. 1 and 2.

In the embodiment shown in FIG. 3, the joint member 130 has a shape with a side surface 131 of the joint member 130 bent inward at a center section 132 (so-called butterfly joint shape). In this regard, the direction along the shortest distance between the center sections 132 is the width direction of the joint member 130, and the direction orthogonal to the axial direction among directions on a butterfly joint plane of the joint member 130 is the height direction of the joint member 130 in the present invention, as shown in FIG. 3.

In the embodiment shown in FIG. 3, the joint member 130 comprises eight rounded corner sections 133. The radius of the rounded corner sections 133 is preferably 6 to 15 mm. The dovetail grooves of wooden panels of joint structures shown in FIGS. 1 and 2 can have a concave shape corresponding to the corner sections of the joint member.

The embodiment shown in FIG. 3 describes an example in which the side surface 131 of the joint member 130 has a V-shape with a valley at the center section 132, but the present invention is not limited thereto. For example, the side surface 131 of the joint member 130 may have an arcuate form which is rounded inward. The side surface 131 may also be shaped so that the entire surface (excluding the center section and the rounded sections) is sloped at less than 90° with respect to the top and bottom surfaces of the joint member 130 (the shape of the top and bottom halves of the joint member 130 is substantially isosceles trapezoidal shape), or may have a shape having a portion that is orthogonal to the top and bottom surfaces of the joint member 130 at a portion connected to the top surface and/or a portion connected to the bottom surface of the joint member 130 on the side surface 131 (the shape of the top and bottom halves of the joint member 130 has a substantially concave shape). In a preferred embodiment, the entire surface of the side surface 131 (excluding the center section and the rounded sections) is sloped at less than 90° with respect to the top and bottom surfaces of the joint member 130.

The length of the joint member 130 in the height direction is preferably about 150 mm to about 270 mm, more preferably about 170 mm to about 240 mm, and most preferably about 180 mm to about 220 mm.

The length of the joint member 130 in the width direction is preferably about 150 mm to about 270 mm, more preferably about 170 mm to about 240 mm, and most preferably about 180 mm to about 220 mm.

The thickness of the joint member 130 is preferably about 90 mm to about 270 mm, more preferably about 90 mm to about 180 mm, and most preferably about 90 mm to about 100 mm.

The shortest length between the surface of one of the side surfaces 131 of the joint member 130 and the surface of the other side surface 131 (i.e., shortest distance between the center sections 132 of the side surfaces 131 in the embodiment shown in FIG. 3) is preferably about 75 mm to about 135 mm, more preferably about 80 mm to about 110 mm, and most preferably about 90 mm to about 100 mm.

The joint member 130 may be a solid member, a hollow member, or configured as a combination of a hollow member and one or more cross braces, as long as it has a sufficient strength to join two wooden members.

Figure 4:
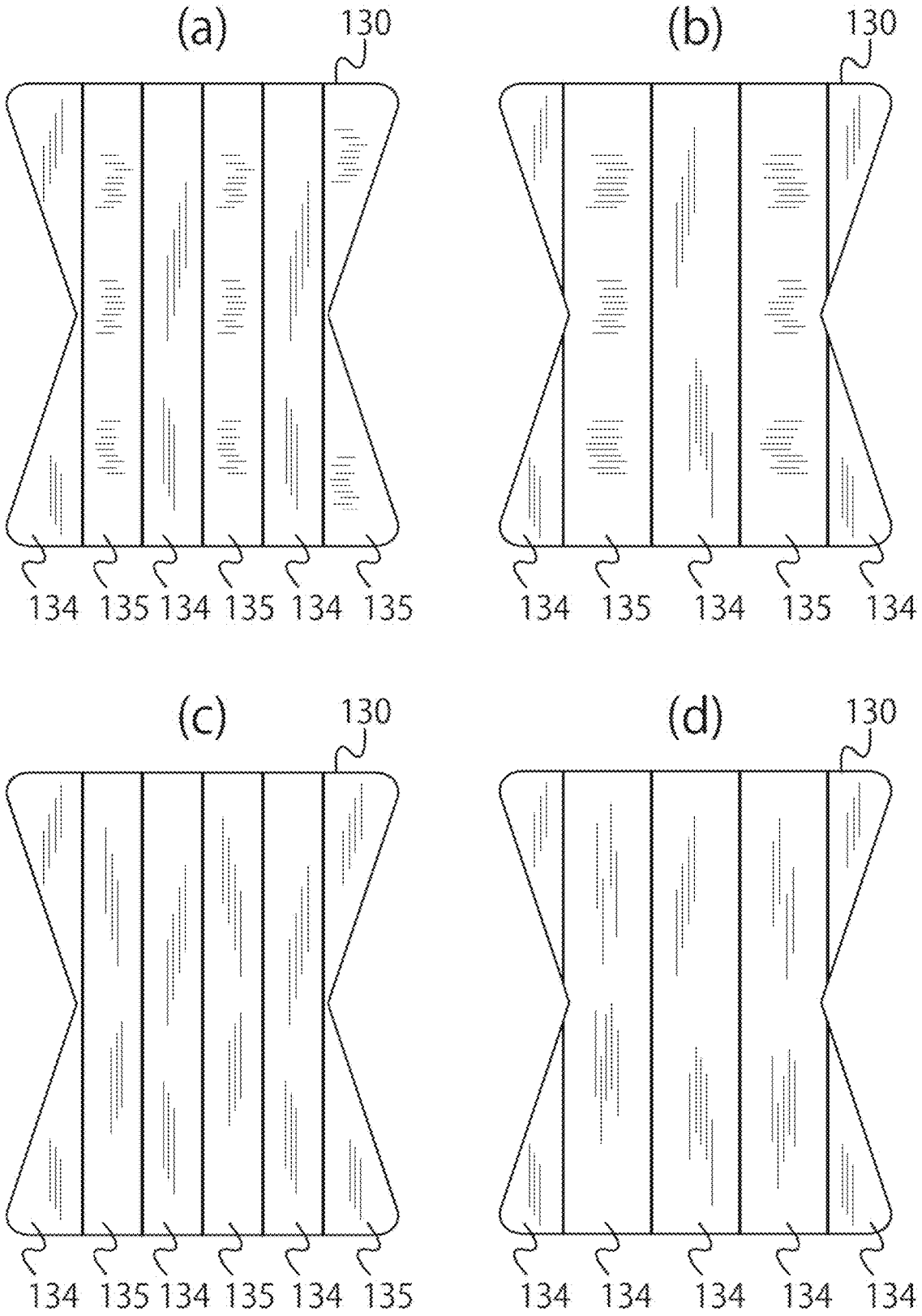
FIG. 4 is a diagram showing an example of the structure of joint member 130.

FIG. 4 shows an example of the structure of the joint member 130. In the embodiment shown in FIG. 4, the joint member 130 is an engineered wood prepared from laminating a plurality of board members.

FIGS. 4*a* and 4*b* show an example of a structure of the joint member 130 comprising a first board member 134 having a first fiber orientation and a second board member 135 having a second fiber orientation which is different from the first fiber orientation.

In the embodiments shown in FIGS. 4*a* and 4*b*, the first board member 134 and the second board member 135 are alternatingly laminated. Specifically, the joint members 130 shown FIGS. 4*a* and 4*b* are fabricated with a "cross laminated timber" prepared (CLT) from laminating a plurality of laminas such that the fiber orientations are orthogonal between adjacent layers (i.e., fiber orientations alternate). Thus, the first fiber orientation of the first board member 134 is substantially orthogonal to the fiber orientation of the second board member 135. In the embodiments shown in FIGS. 4*a* and 4*b*, the height direction of the joint member 130 is substantially identical to the first fiber orientation of the first board member 134.

In the embodiment shown in FIG. 4*a*, the first board member 134 and the second board member 135 are alternatingly laminated at three layers each, in the order of first board member 134, second board member 135, first board member 134, second board member 135, first board member 134, and second board member 135. The thicknesses of each layer of the first board member 134 and the second board member 135 are substantially identical, whereby the strength of the joint member 130 can be symmetric with respect to the central axis in the height direction passing through the center point in the width direction of the joint member 130. In this manner, the strength of a joint structure can be increased by symmetry of the strength of the joint member 130 with respect to the central axis in the height direction of the joint member 130 compared to cases without such a configuration.

In the embodiment shown in FIG. 4*b*, a total of five layers of board members including three layers of the first board member 134 and two layers of the second board member 135 are laminated, in the order of first board member 134, second board member 135, first board member 134, second board member 135, and first board member 134. Specifically, the center first board member 134 is disposed around the central axis in the height direction of the joint member 130, two second board members 135 are disposed to flank the center first board member 134, and two first board members 134 are disposed to further flank the center first board member 134 and two second board members 135. Thus, the strength of the joint member 130 can be symmetric with respect to the central axis in the height direction passing through the center point in the width direction of the joint member 130. In the embodiment shown in FIG. 4*b*, the joint member 130 can be configured so that the total volume of the first board member 134 having the first fiber orientation along the height direction of the joint member 130 is greater than the total volume of the second board member 135 having the second fiber orientation, whereby the strength of a joint structure can be increased compared to cases without such a configuration.

In the same manner as the joint members 130 made of cross laminated timber shown in FIGS. 4*a* and 4*b*, the wooden panel 110 (wooden panel 110') and wooden panel 120 shown in FIGS. 1 and 2 may also be fabricated with a cross laminated timber.

FIGS. 4*c* and 4*d* show an example of the structure of the joint member 130 comprising only the first board member 134 having a first fiber orientation. Specifically, the joint members 130 shown in FIGS. 4*c* and 4*d* are fabricated with a "parallel laminated timber" prepared from laminating a plurality of laminas such that fiber orientations are parallel between adjacent layers. In the embodiments shown in FIGS. 4*c* and 4*d*, the height direction of the joint member 130 is substantially identical to the first fiber orientation of the first board member 134.

In the embodiment shown in FIG. 4*c*, six layers of first board members 134 are laminated, and the thicknesses of each layer of the first board member 134 are substantially identical. Thus, the strength of the joint member 130 can be symmetric with respect to the central axis in the height direction passing through the center point in the width direction of the joint member 130. In this manner, the strength of a joint structure can be increased by symmetry of the strength of the joint member 130 with respect to the central axis in the height direction of the joint member 130 compared to cases without such a configuration.

In the embodiment shown in FIG. 4*d*, five layers of the first board members 134 are laminated. Specifically, the center first board member 134 is disposed around the central axis in the height direction of the joint member 130. Two first board members 134 are further disposed to flank the center first board member 134. Two first board members 134 are disposed to further flank the center first board member 134 and two first board members 134. Thus, the strength of the joint member 130 can be symmetric with respect to the central axis in the height direction passing through the center point in the width direction of the joint member 130.

The embodiment shown in FIG. 4 describes an example where the contact surfaces between a plurality of layers of the joint members 130 are parallel in the height direction of the joint member 130, but the present invention is not limited thereto. For example, the contact surfaces between a plurality of layers of the joint member 130 may extend perpendicularly with respect to the height direction of the contact member 130 (i.e., may extend along the width direction of the joint member 130).

The embodiments shown in FIGS. 4*a* and 4*c* describe an example where the joint member 130 fabricated with a cross laminated timber is comprised of six layers, but the present invention is not limited thereto. The number of layers of the joint member 130 fabricated with a cross laminated timber can be any integer that is two or greater, as long as the fiber orientations between adjacent layers are orthogonal.

The embodiments shown in FIGS. 4*b* and 4*d* describe an example where the joint member 130 fabricated with a parallel laminated timber is comprised of five layers, but the present invention is not limited thereto. The number of layers of the joint member 130 fabricated with a parallel laminated timber can be any integer that is two or greater, as long as the fiber orientations between adjacent layers are parallel.

In a preferred embodiment, the joint member of the invention is comprised of only lumber and does not include a metal part for enhancing the strength of the joint member in the joint member. The inventors have diligently studied the shape, method of laminating board members used, processing for rounding corner sections, etc. considered herein to find that even a joint member comprised of only lumber can achieve a preferred allowable bearing capacity and ultimate bearing capacity as a joint structure.

The embodiment shown in FIG. 4 describes an example where the joint member 130 is fabricated with a cross laminated timber or a parallel laminated timber, but the present invention is not limited thereto. For example, the joint member 130 may be fabricated with resin. If the joint member 130 is made of resin, the joint member 130 may be manufactured by using, for example, a 3D printer.

(Building Comprising the Joint Structure 100)

Figure 5:
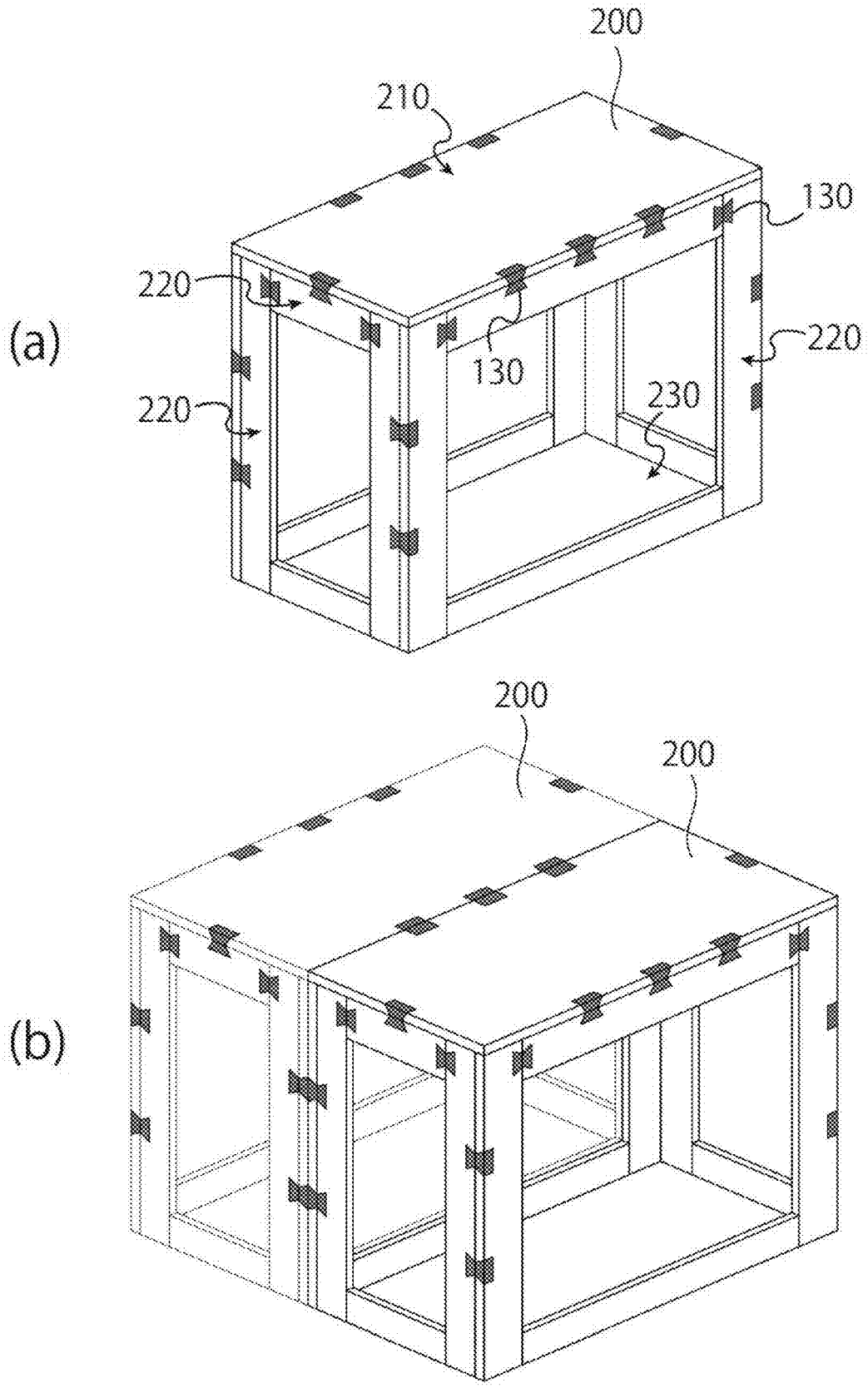
FIG. 5 is a diagram showing an example of a building.

FIG. 5 shows an example of a building. In the embodiment shown in FIG. 5*a*, a building 200 comprises the joint structure 100 shown in FIGS. 1 to 4. Thus, the building 200 comprises the joint member 130. The wooden panel 110 (wooden panel 110') and the wooden panel 120 shown in FIGS. 1 to 2 can correspond to a top board panel 210, a side surface panel 220, and/or a bottom board panel 230 of the building 200. As shown in FIG. 5*a*, the joint member 130 is disposed to join the top board panel 210 and the side surface panel 220 of the building 200, and to join the side surface panel 220 and the side surface panel 220 of the building 200.

As shown in FIG. 5*b*, a plurality of buildings 200 can be coupled to each other and installed in parallel by using, for example, the joint member 130 to construct a larger building.

A plurality of the buildings 200 may be coupled to each other and installed in a stacked manner by using, for example, the joint member 130 to construct a multi-story building. In such a case, the number of joint members on the second floor or higher may be less than the number of joint members on the first floor, whereby the cost of the building can be reduced.

The embodiment shown in FIG. 1*b* describes an example where the dovetail groove $\mathbf{140}_1$ having a shape corresponding to the shape of one half of the joint member 130 is formed on the first wooden panel 110, and the dovetail groove $\mathbf{140}_2$ having a shape corresponding to the shape of the other half of the joint member 130 is formed on the second wooden panel 120, but the present invention is not limited thereto. A first concave section having a shape corresponding to the shape of any part of the joint member 130 can be formed on a surface to be joined of the first wooden panel 110, and a second concave section having a shape corresponding to the shape of the remaining parts of the joint member 130 can be formed on a surface to be joined of the second wooden panel 120, as long as the first wooden panel 110 and the second wooden panel 120 are joined with a sufficient strength with the joint member 130. The same applies to the embodiments shown in FIGS. 2*b*, 4, and 5.

The example shown in FIG. 5*b* describes an example where the buildings 200 are installed in parallel, but the present invention is not limited thereto. For example, a multi-story structure building may be constructed by joining the bottom board panel 230 of the building 200 to the top board panel 210 (e.g., using the joint member 130) to stack one of the buildings 200 on the other building 200.

As disclosed the above, present invention is exemplified by the use of its preferred embodiments. However, the present invention should not be interpreted to be limited to such embodiments. It is understood that the scope of the present invention should be interpreted based solely on the claims. It is understood that those skilled in the art can implement an equivalent scope, based on the descriptions of the invention and common general knowledge, from the descriptions of the specific preferred embodiments of the invention.

EXAMPLES

Example 1. Strength Test on Wooden Joint Members

A joint member having the same outer shape as the joint member 130 shown in FIGS. 1 to 5 was manufactured from a solid wood material of *Cryptomeria japonica* (e.g., flexural strength of about 22.2 N/mm$^2$). Specifically, two substantially trapezoidal members were cut out from a solid *Cryptomeria japonica* material and bolted at the center to fabricate a joint member with the same outer appearance as the joint member 130 (Text Example 1).

A joint structure was fabricated by connecting two sheets of CLT panels (grade $60-3-3: flexural strength along the strong axis in the in-plane direction of 10.8 N/mm$^2$) with the joint member (Test Example 1) to be orthogonal as shown in FIG. 1 or parallel as shown in FIG. 2.

A shearing test was conducted on a joint structure connected orthogonally, and a shearing test and tensile testing were conducted on a joint structure connected in parallel. A load was continuously applied in one direction until a test subject was destroyed in these tests. A 200 kN automatically controlled actuator (maximum stroke: 500 mm) and a load cell (capacity: 200 kN and 100 kN) were used as a load applying apparatus. Measurements were taken using an electronic displacement gauge (sensitivity: $100\times10^{-6}$/mm) and a digital strain measuring device. While applying a force, load and displacement were measured and the test subject was visually inspected.

As a result, the joint member prepared from bolting two members cut out from a solid wood material could not achieve a sufficient strength in each test.

Example 2. Strength Test on a Joint Member Fabricated from a Wooden Engineered Wood The following test examples for each joint member were fabricated.

- Test Example 2: integrated engineered wood joint member fabricated by laminating parallel laminated timbers (Scots pine) without bolting
- Test Example 3: split engineered wood joint member prepared from fabricating two substantially trapezoidal members with parallel laminated timber (Scots pine) that are bolted at the center to give the same outer appearance as the joint member 130
- Test Example 4: integrated LVL joint member fabricated by laminating LVLs
- Test Example 5: split LVL joint member prepared from fabricating two substantially trapezoidal members with LVL that are bolted at the center to give the same outer appearance as the joint member 130

The strength (flexural strength) of the joint members used in Test Examples 2 and 3 was about 30 N/mm$^2$, and the strength (flexural strength) of LVLs used in Test Examples 4 and 5 was about 39 N/mm$^2$.

Joint structures were fabricated by connecting two sheets of CLT panels (grade S60-3-3: flexural strength along the strong axis in the in-plane direction of 10.8 N/mm$^2$) with the joint members of Test Examples 2 to 5 to be orthogonal as shown in FIG. 1 or parallel as shown in FIG. 2. In the same manner as Example 1, a shearing test was conducted on a joint structure connected orthogonally, and a shearing test, bending test, and tensile testing were conducted on a joint structure connected in parallel.

It was found from the comparison of Test Example 2 with Test Example 3 that an integrated engineered wood joint member that is not bolted achieves the same strength as a split engineered wood joint member in a joint structure. An integrated engineered wood joint member is preferable in view of the labor and cost of manufacture, lack of unnecessary use of a metal part, etc. The same tendency was observed in the comparison of Test Example 4 with Test Example 5. When a split joint member was used, the frequency of instances of reduced load in the initial stage was higher compared to when an integrated joint member was used.

Since the strength of the joint member in Test Example 4 was higher than the strength of the joint member in Test Example 2, it was predicted that the strength of a joint structure would be higher with Test Example 4 than Test Example 2. However, CLT panels were actually damaged in each test using the joint structure of Test Example 4, so that the strength as a joint structure was not sufficient. It was found from this result that the balance between the strength of a wooden panel and the strength of a joint member is important in order to achieve a sufficient strength as a joint structure, and even if the strength of either the panel or joint member is notably increased, the strength intended by the present invention as a joint structure is not achieved. While the detailed test results are omitted herein, the inventors found from the results of various tests that the balance between the strength of a wooden panel and the strength of a joint member is excellent when the flexural strength of the joint member is 2.2 to 3.6 fold with respect to the flexural strength of the wooden panel.

Example 3. Investigation of the Shape of a Joint Member

This Example investigated the shape of a joint member. A joint member (left side of FIG. 6) with a shape of the joint member 130 shown in FIGS. 1 to 5 (i.e., shapes of the top and bottom halves are substantially isosceles trapezoidal shapes) and a joint member (right side of FIG. 6) with the top and bottom halves having a substantially concave shape in the joint member 130 were prepared.

Two sheets of CLT panels were connected to be orthogonal with each of the two joint members to conduct a bending test. The bending test applied one set of cyclic loads of $1/450$, $1/300$, $1/200$, $1/150$, $1/100$, $1/75$, $1/50$, and $1/30$ rad in terms of apparent distortion angles. After $1/30$ rad, one directional load was continuously applied until destruction of the test subject. A hydraulic jack (maximum stroke: 500 mm) and a load cell (capacity: 200 kN and 100 kN) were used as a load applying apparatus. Measurements were taken an using electronic displacement gauge (sensitivity: 100 and $33\times10^{-6}$/mm) and a digital strain measuring device. While applying a force, load and displacement were measured and the test subjects were visually inspected.

Figure 6:
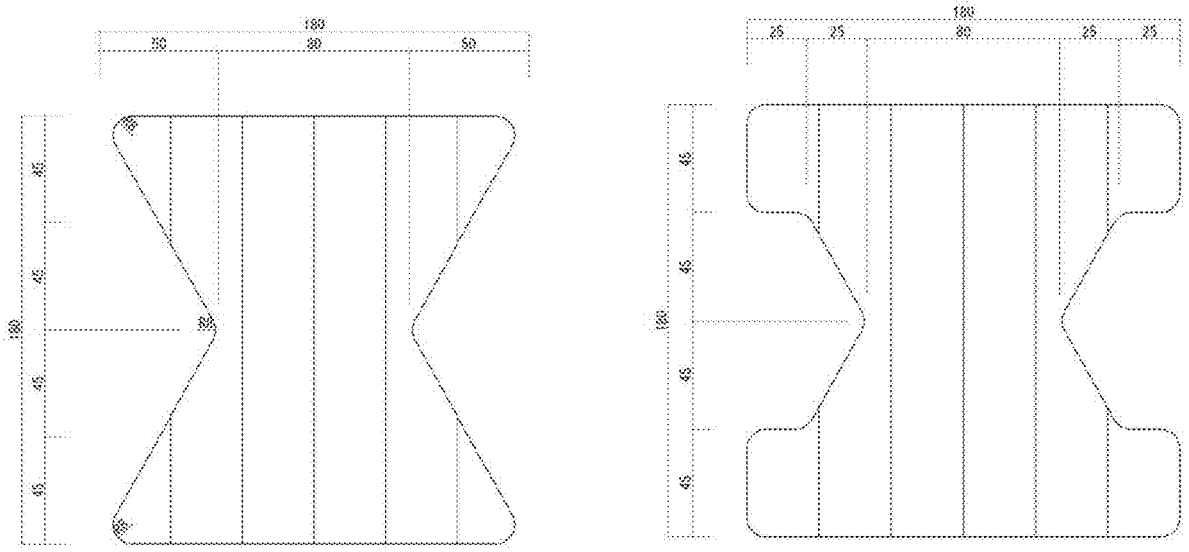
FIG. 6 illustrates a diagram showing and example of an member.

It was found as a result that the joint member on the left side of FIG. 6 is more preferable.

Example 4. Measurement of Strength of a Joint Structure

Examples 1 to 4 suggest that a joint structure with two sheets of CLT panels connected with an integrated joint member prepared from laminating parallel laminated timbers has a preferred strength. In this regard, whether the joint structure of the invention has a sufficient strength for a building was investigated through measurements and calculation.

Two sheets of CLT panels (grade S60-3-3) (thickness of 90 mm) were used. A joint member was fabricated by cutting out a symmetric engineered wood comprised of different grade wood (Scots pine) such that the fiber orientation of each board member in the engineered wood would be along the height direction of the joint member. The shape of the joint member was the shape of the joint member 130 shown in FIGS. 1 to 5 (i.e., the shapes of the top and bottom halves are substantially isosceles trapezoidal shapes). The radius of a corner section was 8 and did not include a bolt, etc. in an integrated form.

Joint structures were fabricated by connecting two sheets of CLT panels with a joint member to be orthogonal as shown in FIG. 1 or parallel as shown in FIG. 2. A shearing test was conducted on a joint structure connected orthogonally, and a shearing test and tensile testing were conducted on a joint structure connected in parallel in the same manner as Example 1, except for conducting tests on six test subjects each.

As a result, the following allowable bearing capacity and ultimate bearing capacity were obtained.

The allowable bearing capacity was 18.04 kN, and the ultimate bearing capacity was 29.17 kN in a shearing test on a joint structure prepared from connecting two CLT panels in parallel.

The allowable bearing capacity was 14.25 kN, and the ultimate bearing capacity was 20.95 kN in a shearing test on a joint structure prepared from connecting two CLT panels orthogonally.

The allowable bearing capacity was 12.62 kN, and the ultimate bearing capacity was 25.10 kN in tensile testing on a joint structure prepared from connecting two CLT panels in parallel.

It was found in view of the above results that the joint structure of the invention has an allowable bearing capacity and ultimate bearing capacity that are sufficiently usable in a building.

While Examples 1 to 4 described above yielded results from testing using a joint member with a size of 180×180 mm square, a significant difference was not found in the rigidity and bearing capacity of a joint structure even when a joint member with a size of a 220×220 mm square was used.

Figure 7:
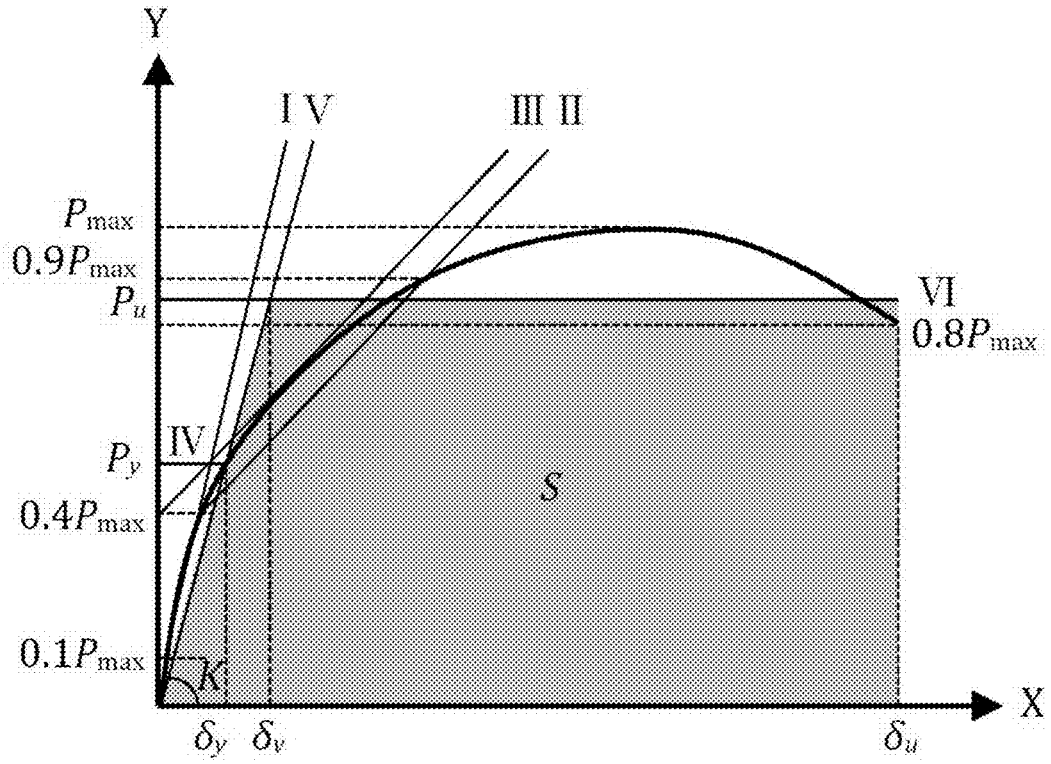
FIG. 7 illustrates a plot showing an elastoplastic model of the joint member's bearing capacity.

The following is the method of creating a perfect elastoplastic model to find allowable bearing capacity Pa=min ($P_y$, $\frac{2}{3}P_{max}$) and ultimate bearing capacity $P_u$. FIG. 7 shows the method of finding a characteristic value through a perfect elastoplastic model.

a) Draw straight line number I connecting 0.1 $P_{max}$ and 0.4 $P_{max}$ on the envelop.

b) Draw straight line number II connecting 0.4 $P_{max}$ and 0.9 $P_{max}$ on the envelop.

c) Move straight line number II in parallel until it is tangent with the envelop and use it as straight line number III.

d) Use the load at t intersection of straight line number I and straight line number III as yield point load $P_y$, and draw straight line number IV that is parallel to the X axis from this point.

e) Use the displacement of the intersection of straight line number IV and the envelop as yield displacement $\delta_y$.

f) Use a straight line connecting the origin and ($\delta_y$, $P_y$) as straight line number V, and determine the slope thereof as initial rigidity K.

g) Determine the displacement on the envelop of 0.8 $P_{max}$ reduced load region after the maximum load as ultimate displacement $\delta_u$. If the load is not reduced to 0.8 $P_{max}$ until the completion of the test, use the displacement as of the completion of the test as $\delta_u$.

h) Use the area surrounded by the envelop, X-axis, and straight line of $x=\delta_u$ as S.

i) Draw straight line number VI parallel to the X axis so that the trapezoidal area surrounded by straight line number V, straight line of $x=\delta_u$, X axis, and straight line parallel to the X axis would be equal to S.

j) Determine the load at the intersection of straight line number V and straight line number VI as ultimate bearing capacity $P_u$ of a perfect elastoplastic model, and use the displacement at this time as yield point displacement $\delta_y$ of the perfect elastoplastic model.

k) Use plasticity rate as $\mu=\delta_u/\delta_y$.

INDUSTRIAL APPLICABILITY

The present invention useful as an invention providing joint structure comprising joint member suited for a butterfly joint, building, etc.

REFERENCE SIGNS LIST

100 Joint structure
110, 110', 120 Wooden panel
130 Joint member
200 Building

The invention claimed is:

1. A joint structure comprising a first wooden panel, a second wooden panel, and a butterfly joint member for joining the first wooden panel and the second wooden panel, wherein the joint structure has an allowable bearing capacity of about 10 kN or greater, wherein the joint member comprises engineered wood prepared from laminating a plurality of board members, wherein the plurality of board members comprise a first board member having a first fiber orientation and a second board member having a second fiber orientation which is different from the first fiber orientation, a total volume of the first board member is greater than a total volume of the second board member, and a height direction of the joint member is substantially identical to the first fiber orientation.

2. The joint structure of claim 1, wherein the joint member has a rounded corner section.

3. The joint structure of claim 2, wherein a radius of the rounded corner section is 6 to 15 mm.

4. The joint structure of claim 1, wherein a dovetail groove is formed at each of a predetermined position on a joint section of the first wooden panel and a predetermined position on a joint section of the second wooden panel, a cross-sectionally dovetail shaped space corresponding to a shape of the joint member is formed by matching a position of a dovetail groove of the first wooden panel and a position of a dovetail groove of the second wooden panel, and the first wooden panel and the second wooden panel are configured to be joined with each other by inserting the joint member into the cross-sectionally dovetail shaped space.

5. The joint structure of claim 1, wherein the joint structure does not comprise a metal part for joining the first wooden panel and the second wooden panel.

6. The joint structure of claim 1, wherein the first wooden panel and the second wooden panel are fabricated with a cross laminated timber.

7. The joint structure of claim 1, wherein lengths of the first wooden panel and the second wooden panel in a width direction are each about 300 mm to about 800 mm.

8. The joint structure of claim 1, wherein a size of the joint member has a length in a height direction of about 150 mm to about 270 mm, a length in a width direction of about 150 mm to about 270 mm, a thickness of about 90 mm to about 270 mm, and a shortest length between side surfaces of about 75 mm to about 135 mm.

9. The joint structure of claim 1, wherein flexural strength of the wooden panels: flexural strength of the joint member is 1:2.2 to 1:3.6.

10. The joint structure of claim 1, wherein the joint structure has an ultimate bearing capacity of about 18 kN or greater.

11. A building comprising the joint structure of claim 1.

12. A joint member used in the joint structure of claim 1.

13. A joint structure comprising a first wooden panel, a second wooden panel, and a butterfly joint member for joining the first wooden panel and the second wooden panel, wherein the joint structure has an allowable bearing capacity of about 10 kN or greater, wherein the joint member comprises engineered wood prepared from laminating a plurality of board members, wherein the plurality of board members comprise only a plurality of first board members having a first fiber orientation, and a height direction of the joint member is substantially identical to the first fiber orientation.

14. The joint structure of claim 13, wherein the joint member has a structure prepared from laminating the plurality of first board members such that a strength of the plurality of first board members is symmetric with respect to a central axis in the height direction of the joint member.

* * * * *